US008224220B2

(12) United States Patent
Okamoto et al.

(10) Patent No.: US 8,224,220 B2
(45) Date of Patent: Jul. 17, 2012

(54) FIXING DEVICE AND IMAGE FORMING APPARATUS CAPABLE OF ADJUSTING AMOUNT OF OIL APPLIED FOR FIXING

(75) Inventors: Masami Okamoto, Yamato (JP); Jun Okamoto, Kawasaki (JP); Kazuo Suno, Mito (JP); Kenji Nozawa, Hitachinaka (JP); Naoto Suzuki, Hitachinaka (JP); Syoichi Kaneko, Ishioka (JP); Yoshihiro Sonohara, Hitachi (JP); Keisuke Kubota, Hitachinaka (JP); Takashi Kagami, Mito (JP); Hiroyuki Shimada, Zama (JP)

(73) Assignee: Ricoh Company, Limited, Tokyo (JP)

( * ) Notice: Subject to any disclaimer, the term of this patent is extended or adjusted under 35 U.S.C. 154(b) by 139 days.

(21) Appl. No.: 12/434,288

(22) Filed: May 1, 2009

(65) Prior Publication Data

US 2009/0274495 A1 Nov. 5, 2009

(30) Foreign Application Priority Data

May 2, 2008 (JP) ..... 2008-120447

(51) Int. Cl.
*G03G 15/20* (2006.01)

(52) U.S. Cl. ..... 399/325; 399/320; 399/324

(58) Field of Classification Search ..... 399/320, 399/324–325
See application file for complete search history.

(56) References Cited

U.S. PATENT DOCUMENTS

| | | | | |
|---|---|---|---|---|
| 5,678,153 | A | 10/1997 | Okamoto et al. | |
| 7,509,085 | B2 | 3/2009 | Yoshinaga et al. | |
| 2002/0028099 | A1 * | 3/2002 | Yamamoto et al. | 399/328 |
| 2002/0044805 | A1 * | 4/2002 | Hasegawa | 399/325 |
| 2003/0095806 | A1 * | 5/2003 | Wu et al. | 399/325 |
| 2007/0077103 | A1 * | 4/2007 | Pino et al. | 399/325 |
| 2007/0237554 | A1 | 10/2007 | Mitsuya et al. | |
| 2008/0013995 | A1 | 1/2008 | Kubota et al. | |
| 2008/0170896 | A1 | 7/2008 | Kubota et al. | |
| 2009/0274477 | A1 | 11/2009 | Okamoto et al. | |
| 2009/0274494 | A1 | 11/2009 | Okamoto et al. | |
| 2009/0274496 | A1 | 11/2009 | Okamoto et al. | |
| 2009/0274497 | A1 | 11/2009 | Okamoto et al. | |
| 2009/0274498 | A1 | 11/2009 | Okamoto et al. | |

FOREIGN PATENT DOCUMENTS

| | | | |
|---|---|---|---|
| JP | 05027637 | A * | 2/1993 |
| JP | 06308849 | A * | 11/1994 |
| JP | 2008-46663 | | 2/2008 |
| JP | 4115733 | | 4/2008 |

OTHER PUBLICATIONS

English Translation of JP Hori 5-27637A.*
English Abstract of Hori JP 5-27637A.*
JP 06308849 A to Kusumoto et al., English Abstract, Nov. 1994.*

* cited by examiner

*Primary Examiner* — Ryan Walsh
(74) *Attorney, Agent, or Firm* — Oblon, Spivak, McClelland, Maier & Neustadt, L.L.P.

(57) ABSTRACT

A fixing device includes a rotatable fixing member, a pressing member, a motor, and an oil applier. The pressing member contacts the fixing member. The oil applier includes an application roller and an oil supply mechanism. The application roller applies oil to one of the fixing member and the pressing member. The oil supply mechanism supplies oil to the application roller. The motor is provided independent of other drivers, and supplies a driving force to the application roller to rotate the application roller at an arbitrary speed.

20 Claims, 10 Drawing Sheets

FIXING DEVICE AND IMAGE FORMING APPARATUS CAPABLE OF ADJUSTING AMOUNT OF OIL APPLIED FOR FIXING

CROSS-REFERENCE TO RELATED APPLICATION

The present application is based on and claims priority to Japanese Patent Application No. 2008-120447, filed on May 2, 2008 in the Japan Patent Office, the entire contents of which are hereby incorporated herein by reference.

BACKGROUND OF THE INVENTION

1. Field of the Invention

Exemplary aspects of the present invention relate to a fixing device and an image forming apparatus, and more particularly, to a fixing device and an image forming apparatus including the fixing device for fixing a toner image on a recording medium.

2. Description of the Related Art

Related-art image forming apparatuses, such as copiers, facsimile machines, printers, or multifunction printers having at least one of copying, printing, scanning, and facsimile functions, typically form an image on a recording medium (e.g., a sheet) according to image data using electrophotography. Thus, for example, a charger uniformly charges a surface of an image carrier; an optical writer emits a light beam onto the charged surface of the image carrier to form an electrostatic latent image on the image carrier according to the image data; a development device supplies toner particles to the electrostatic latent image formed on the image carrier to make the electrostatic latent image visible as a toner image; the toner image is directly transferred from the image carrier onto a sheet or is indirectly transferred from the image carrier onto a sheet via an intermediate transfer member; a cleaner then cleans the surface of the image carrier after the toner image is transferred from the image carrier onto the sheet; finally, a fixing device applies heat and pressure to the sheet bearing the toner image to fix the toner image on the sheet, thus forming the image on the sheet.

In such image forming apparatuses, oil is applied to a fixing member of the fixing device, which contacts the toner image on the sheet, to separate toner particles forming the toner image from the fixing member and to maintain fixing property, or the ability of the fixing member to fix the toner image on the sheet. Understanding the way in which the oil is applied requires a detailed discussion of the structure of a typical conventional fixing device.

In order to shorten a warm-up time period of the fixing device, an endless fixing belt is often used as the fixing member. FIG. 1 is a sectional view of a fixing device 100RA including just such an endless fixing belt.

As can be seen in FIG. 1, the fixing device 100RA loops an endless fixing belt 92 around a fixing roller 84 and a heating roller 83 in such a manner that the fixing roller 84 and the heating roller 83 apply a predetermined tension to the fixing belt 92. A pressing roller 85 rotates and presses against the fixing belt 92 and the fixing roller 84 to form a fixing nip portion AR between the fixing belt 92 and the pressing roller 85. A heater 86 is disposed inside the heating roller 83, and heats the fixing belt 92 via the heating roller 83. Similarly, a second, separate heater 87 is disposed inside the pressing roller 85, and heats the pressing roller 85. The fixing belt 92 and the pressing roller 85 apply heat and pressure to a sheet bearing a toner image at the fixing nip portion AR to fix the toner image on the sheet.

An oil application roller R1 serves as an oil applier for applying oil to the fixing belt 92. For example, the rotating oil application roller R1 applies oil supplied from an oil supplier to the fixing belt 92 at a contact point 95 at which the oil application roller R1 contacts the fixing belt 92. The rotating fixing belt 92 moves an oiled portion of the fixing belt 92 to which oil is applied to the fixing nip portion AR to separate the sheet bearing the toner image from the fixing belt 92. At the fixing nip portion AR, a part of the oil on the fixing belt 92 moves from the fixing belt 92 onto a surface of the pressing roller 85 to separate the sheet bearing the toner image from the pressing roller 85. Surplus oil carried on the pressing roller 85 then flows into an oil pan 96 provided under the pressing roller 85, and is collected by the oil pan 96.

However, an amount of oil to be applied by the oil application roller R1 may vary depending on sheet type, such as plain paper or coated paper. For example, more oil needs to be applied to the fixing belt 92 when a toner image is formed on coated paper than when a toner image is formed on plain paper. Accordingly, when the oil application roller R1 does not apply enough oil to the fixing belt 92, coated paper bearing a toner image may not separate cleanly from the fixing belt 92.

BRIEF SUMMARY OF THE INVENTION

This specification describes below a fixing device according to an exemplary embodiment of the present invention. In one exemplary embodiment of the present invention, the fixing device includes a rotatable fixing member, a pressing member, a motor, and an oil applier. The pressing member contacts the fixing member. The oil applier includes an application roller and an oil supply mechanism. The application roller applies oil to one of the fixing member and the pressing member. The oil supply mechanism supplies oil to the application roller. The motor is provided independent of other drivers, and supplies a driving force to the application roller to rotate the application roller at an arbitrary speed.

This specification further describes below a fixing device according to an exemplary embodiment of the present invention. In one exemplary embodiment of the present invention, the fixing device includes a rotatable fixing member, a pressing member, a motor, a controller, a type selector, and an oil applier. The pressing member contacts the fixing member to form a fixing nip portion between the fixing member and the pressing member to fix a toner image on a recording medium. The oil applier includes an application roller and an oil supply mechanism. The application roller applies oil to one of the fixing member and the pressing member. The oil supply mechanism supplies oil to the application roller. The motor is provided independent of other drivers, and supplies a driving force to the application roller to rotate the application roller at an arbitrary speed. The type selector provides information about type of the recording medium selected by a user to the controller. The controller changes the speed of the application roller according to the type of the recording medium provided by the type selector to adjust an amount of oil to be applied to one of the fixing member and the pressing member.

This specification further describes below an image forming apparatus according to an exemplary embodiment of the present invention. In one exemplary embodiment of the present invention, the image forming apparatus includes a fixing device including a rotatable fixing member, a pressing member, a motor, and an oil applier. The pressing member contacts the fixing member. The oil applier includes an application roller and an oil supply mechanism. The application roller applies oil to one of the fixing member and the pressing member. The oil supply mechanism supplies oil to the application roller. The motor is provided independent of other drivers, and supplies a driving force to the application roller to rotate the application roller at an arbitrary speed.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
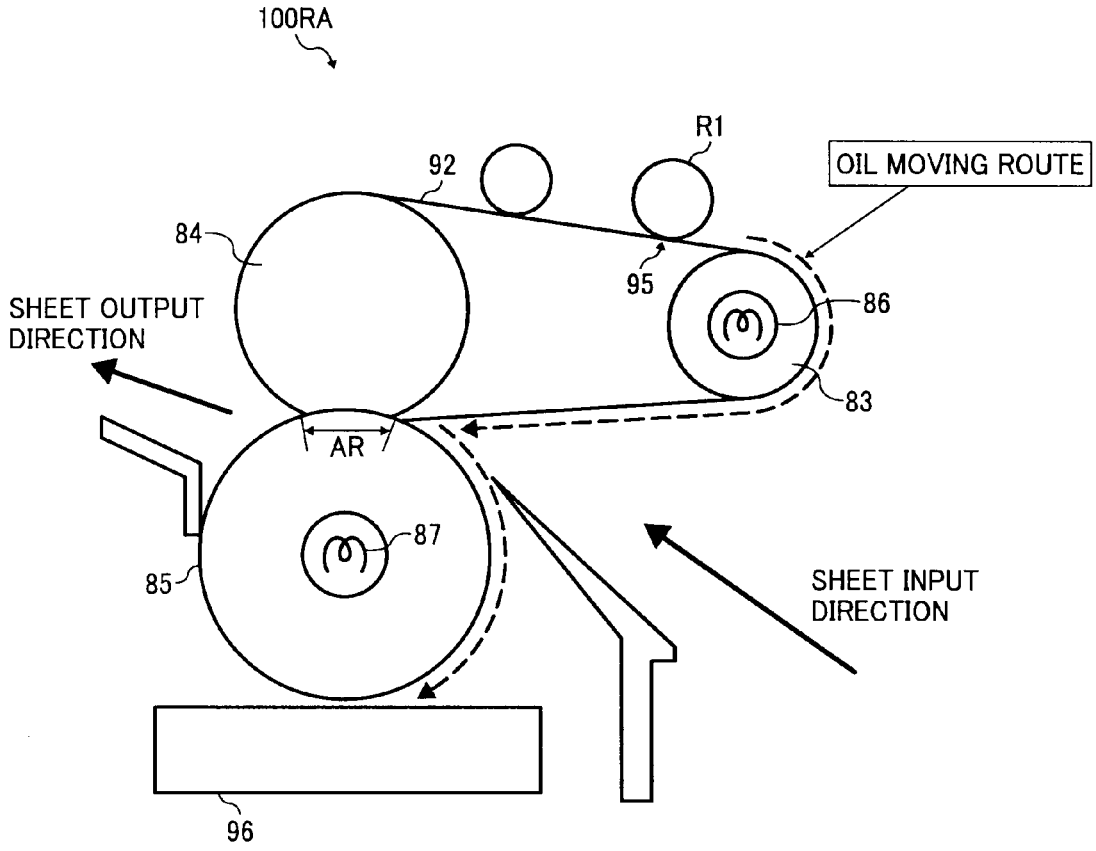
FIG. 1 RELATED ART
FIG. 1 is a sectional view of a related-art fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 2:
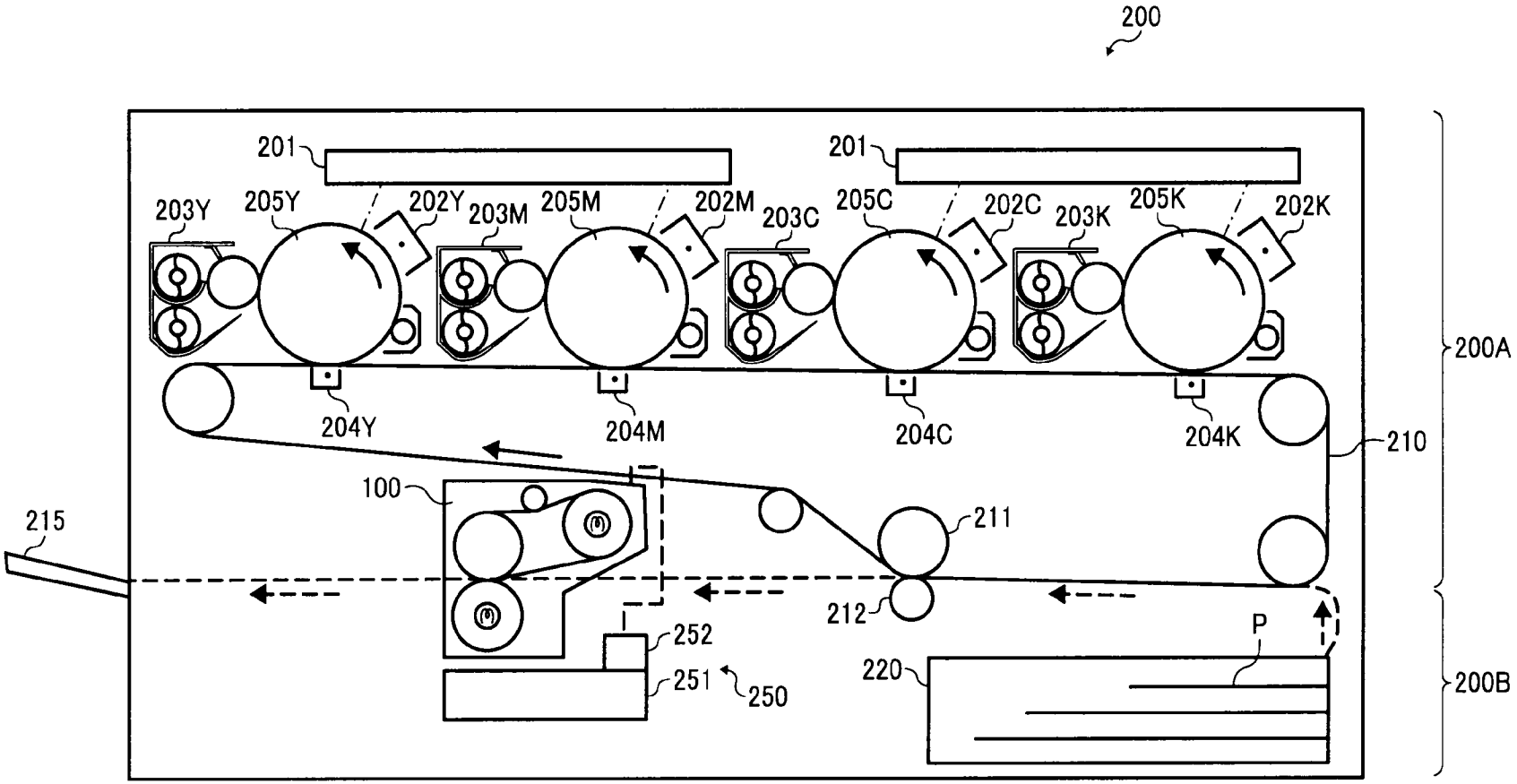
FIG. 2 is a sectional view of an image forming apparatus according to an exemplary embodiment of the present invention.

Referring now to the drawings, wherein like reference numerals designate identical or corresponding parts throughout the several views, in particular to FIG. 2, an image forming apparatus 200 according to an exemplary embodiment of the present invention is explained.

As illustrated in FIG. 2, the image forming apparatus 200 includes an image forming device 200A, a sheet supplier 200B, and a stacker 215.

The image forming device 200A includes optical writers 201, chargers 202Y, 202M, 202C, and 202K, development devices 203Y, 203M, 203C, and 203K, first transfer devices 204Y, 204M, 204C, and 204K, photoconductors 205Y, 205M, 205C, and 205K, a transfer belt 210, a roller 211, a transfer roller 212, a fixing device 100, and an oil circulation mechanism 250. The sheet supplier 200B includes a paper tray 220. The oil circulation mechanism 250 includes an oil tank 251 and an oil pump 252.

The image forming apparatus 200 can be a copier, a facsimile machine, a printer, a plotter, a multifunction printer having at least one of copying, printing, scanning, plotter, and facsimile functions, or the like. According to this non-limiting exemplary embodiment of the present invention, the image forming apparatus 200 functions as a tandem type color copier for forming a color image on a recording medium at high speed by electrophotography.

The image forming device 200A is provided at a center portion of the image forming apparatus 200. The sheet supplier 200B is provided under the image forming device 200A. An image reader is provided above the image forming device 200A.

In the image forming device 200A, the transfer belt 210 includes a transfer surface extending in a horizontal direction. A mechanism for forming an image in a complementary color being complementary to a separation color is provided above the transfer belt 210. For example, the photoconductors 205Y, 205M, 205C, and 205K, serving as image carriers for carrying toner images in complementary colors (e.g., yellow, magenta, cyan, and black), are arranged along the transfer surface of the transfer belt 210.

The photoconductors 205Y, 205M, 205C, and 205K are formed of drums which rotate in an identical direction (e.g., counterclockwise in FIG. 2), respectively. The optical writers 201, the chargers 202Y, 202M, 202C, and 202K, the development devices 203Y, 203M, 203C, and 203K, the first transfer devices 204Y, 204M, 204C, and 204K, and cleaners surround the photoconductors 205Y, 205M, 205C, and 205K, respectively, to perform image forming processes while the photoconductors 205Y, 205M, 205C, and 205K rotate. The development devices 203Y, 203M, 203C, and 203K contain yellow, magenta, cyan, and black toners, respectively.

The transfer belt 210 is looped over a driving roller and a driven roller, and opposes the photoconductors 205Y, 205M, 205C, and 205K to move in a direction corresponding to the direction of rotation of the photoconductors 205Y, 205M, 205C, and 205K. The transfer roller 212 opposes the roller 211 serving as a driven roller.

In the sheet supplier 200B, the paper tray 220 loads sheets P serving as a recording medium. A conveyance mechanism feeds the sheets P loaded on the paper tray 220 one by one toward the transfer roller 212. For example, the conveyance mechanism separates an uppermost sheet P from other sheets P loaded on the paper tray 220, and conveys the sheet P toward the transfer roller 212. A conveyance path provided between the transfer roller 212 and the fixing device 100 conveys the sheet P in a horizontal direction.

The following describes image forming operations performed by the image forming apparatus 200. The charger 202Y uniformly charges a surface of the photoconductor 205Y. The optical writer 201 forms an electrostatic latent image on the charged surface of the photoconductor 205Y according to image data sent by the image reader. The development device 203Y for containing the yellow toner makes the electrostatic latent image formed on the photoconductor 205Y visible as a yellow toner image. The first transfer device 204Y applies a predetermined bias to the yellow toner image formed on the photoconductor 205Y to transfer the yellow toner image onto the transfer belt 210. Similarly, magenta, cyan, and black toner images are formed on the photoconductors 205M, 205C, and 205K, respectively, and sequentially transferred onto the transfer belt 210 by an electrostatic force so that the yellow, magenta, cyan, and black toner images are superimposed on the transfer belt 210 to form a color toner image on the transfer belt 210.

The transfer roller 212 transfers the color toner image from the transfer belt 210 onto the sheet P conveyed by the roller 211 and the transfer roller 212. The sheet P bearing the color toner image is further conveyed to the fixing device 100. The fixing device 100 fixes the color toner image on the sheet P. The sheet P bearing the fixed color toner image is sent to the stacker 215 via an output path.

The oil tank 251 collects oil used in the fixing device 100 to improve property for separating the sheet P from the fixing device 100. The oil pump 252 resupplies oil contained in the oil tank 251 to the fixing device 100. The oil tank 251 and the oil pump 252 serve as the oil circulation mechanism 250 (e.g., an oil circulation system) provided for the fixing device 100.

Figure 3:
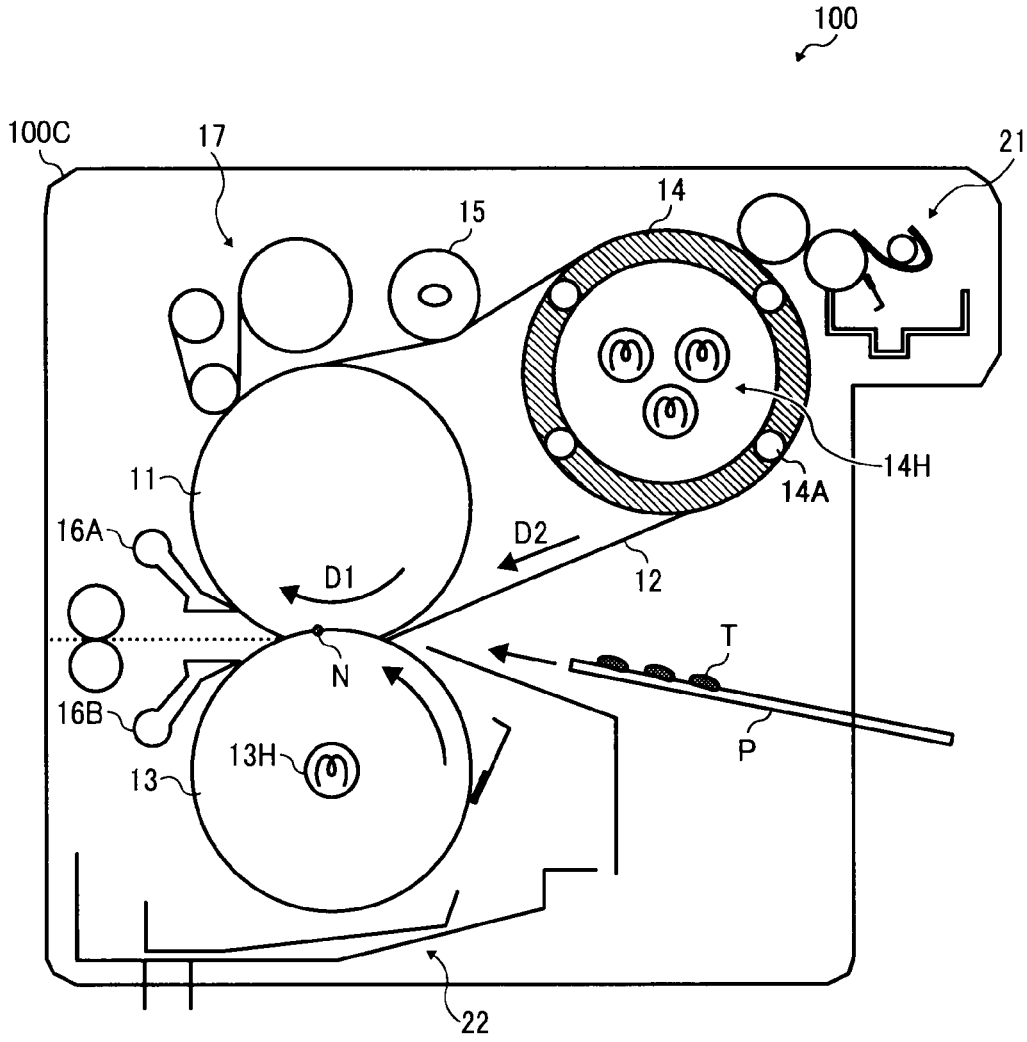
FIG. 3 is a sectional view of a fixing device included in the image forming apparatus shown in FIG. 2.

FIG. 3 is a sectional view of the fixing device 100. The fixing device 100 includes a fixing cover 100C, a fixing roller 11, a fixing belt 12, a pressing roller 13, a heater 13H, a heating roller 14, a heat pipe 14A, a heater 14H, a tension roller 15, separation nails 16A and 16B, a cleaning mechanism 17, and oil appliers 21 and 22.

The fixing roller 11, the fixing belt 12, the pressing roller 13, the heating roller 14, the separation nails 16A and 16B, and the cleaning mechanism 17 are provided inside the fixing cover 100C. The fixing belt 12, serving as a fixing member, is looped or stretched over the fixing roller 11 and the heating roller 14 with a predetermined tension. The pressing roller 13, serving as a pressing member, rotatably presses against the fixing belt 12 to form a fixing nip portion N between the fixing belt 12 and the pressing roller 13. The fixing belt 12 and the pressing roller 13 apply heat and pressure to a sheet P bearing a toner image T at the fixing nip portion N to fix the toner image T on the sheet P. The separation nail 16A is provided at an exit side of the fixing nip portion N in such a manner that a head of the separation nail 16A contacts or is disposed close to the fixing belt 12, so as to prevent a sheet P from wrapping around the fixing belt 12. The separation nail 16B is provided at the exit side of the fixing nip portion N in such a manner that a head of the separation nail 16B contacts the pressing roller 13, so as to prevent a sheet P from wrapping around the pressing roller 13. The cleaning mechanism 17 cleans the fixing belt 12 by pressing a cleaning web against the fixing belt 12.

The fixing belt 12 has an endless belt shape and has a double-layer structure in which an elastic layer, such as a silicon rubber layer, is formed on a base including nickel, stainless steel, and/or polyimide. The fixing roller 11 includes metal serving as a core metal and silicon rubber. In order to shorten a warm-up time period of the fixing device 100, the fixing roller 11 may include foamed silicon rubber so that the fixing roller 11 does not absorb heat from the fixing belt 12 easily. The heating roller 14 is formed of a hollow roller including aluminum or iron. The heater 14H, such as a halogen heater, serves as a heat source and is provided inside the heating roller 14. Alternatively, an induction heating (IH) mechanism may serve as the heat source. A plurality of heat pipes 14A, which is formed of hollow pipes, is provided in a thick wall of the heating roller 14. For example, the heat pipes 14A are embedded in the thick wall of the heating roller 14 in such a manner that the heat pipes 14A are evenly spaced in a circumferential direction of the heating roller 14 and that a longitudinal direction of the heat pipes 14A corresponds to a longitudinal direction (e.g., a width direction or an axial direction) of the heating roller 14. The heat pipes 14A improve heat transmission from the heater 14H to a surface of the heating roller 14, and thereby the heating roller 14 uniformly heats the fixing belt 12 quickly.

When the fixing device 100 is driven, in a state in which the tension roller 15 presses against the fixing belt 12 to apply proper tension to the fixing belt 12, the fixing roller 11 rotates clockwise in FIG. 3 in a direction of rotation D1 to rotate the fixing belt 12 clockwise in FIG. 3 in a direction of rotation D2 in which the fixing belt 12 feeds a sheet P out of the fixing nip portion N. Thus, the rotating fixing belt 12 rotates the pressing roller 13. Alternatively, instead of the fixing roller 11, the pressing roller 13 or the heating roller 14 may drive and rotate the fixing belt 12. In order to fix a toner image T on a sheet P, the heater 14H provided inside the heating roller 14 generates heat to heat the fixing belt 12 until a thermistor detects that the fixing belt 12 is heated up to a predetermined temperature (e.g., a proper fixing temperature). According to this exemplary embodiment, the fixing belt 12, that is, an endless belt, serves as a fixing member. Alternatively, a fixing roller, for example, a hollow cylindrical roller, may serve as a fixing member.

The pressing roller 13 is formed of a cylindrical roller in which an elastic layer including silicon rubber is provided on a core metal including aluminum or iron. A pressure applier applies constant pressure to the pressing roller 13 to press the pressing roller 13 against the fixing belt 12. The heater 13H is provided inside the pressing roller 13, and generates heat to heat the pressing roller 13 up to a predetermined temperature as needed, for example, to fix a toner image T on a sheet P.

In the fixing device 100, a surface of the fixing belt 12 is heated up to a predetermined temperature in a state in which the fixing belt 12 and the pressing roller 13 are driven and rotated. When a sheet P bearing an unfixed toner image T passes through the fixing nip portion N, that is, when the sheet P moves leftward in FIG. 3, the fixing belt 12 and the pressing roller 13 apply heat and pressure to the sheet P at the fixing nip portion N to melt and fix the unfixed toner image T on the sheet P.

When the sheet P bearing the fixed toner image T is discharged from the fixing nip portion N, the sheet P may adhere to or wrap around the fixing belt 12 or the pressing roller 13. To address this, the oil appliers 21 and 22 apply oil to the fixing belt 12 and the pressing roller 13 to improve property for separating the sheet P from the fixing belt 12 and the pressing roller 13, respectively. The applied oil may be heat-resistant fixed oil, such as silicon oil. When the head of the separation nail 16A or 16B contacts a leading edge of the sheet P, the separation nail 16A or 16B separates the sheet P from the fixing belt 12 or the pressing roller 13, respectively. The sheet P discharged from the fixing nip portion N passes through a predetermined discharge path and is sent out of the fixing device 100.

The oil appliers 21 and 22 apply a proper amount of oil to the fixing belt 12 and the pressing roller 13, respectively. The separation nails 16A and 16B provided at the exit side of the fixing nip portion N operate as needed. Accordingly, the sheet P is discharged out of the fixing nip portion N to the exit side of the fixing nip portion N without adhering to or wrapping around the fixing belt 12 or the pressing roller 13.

Figure 4:
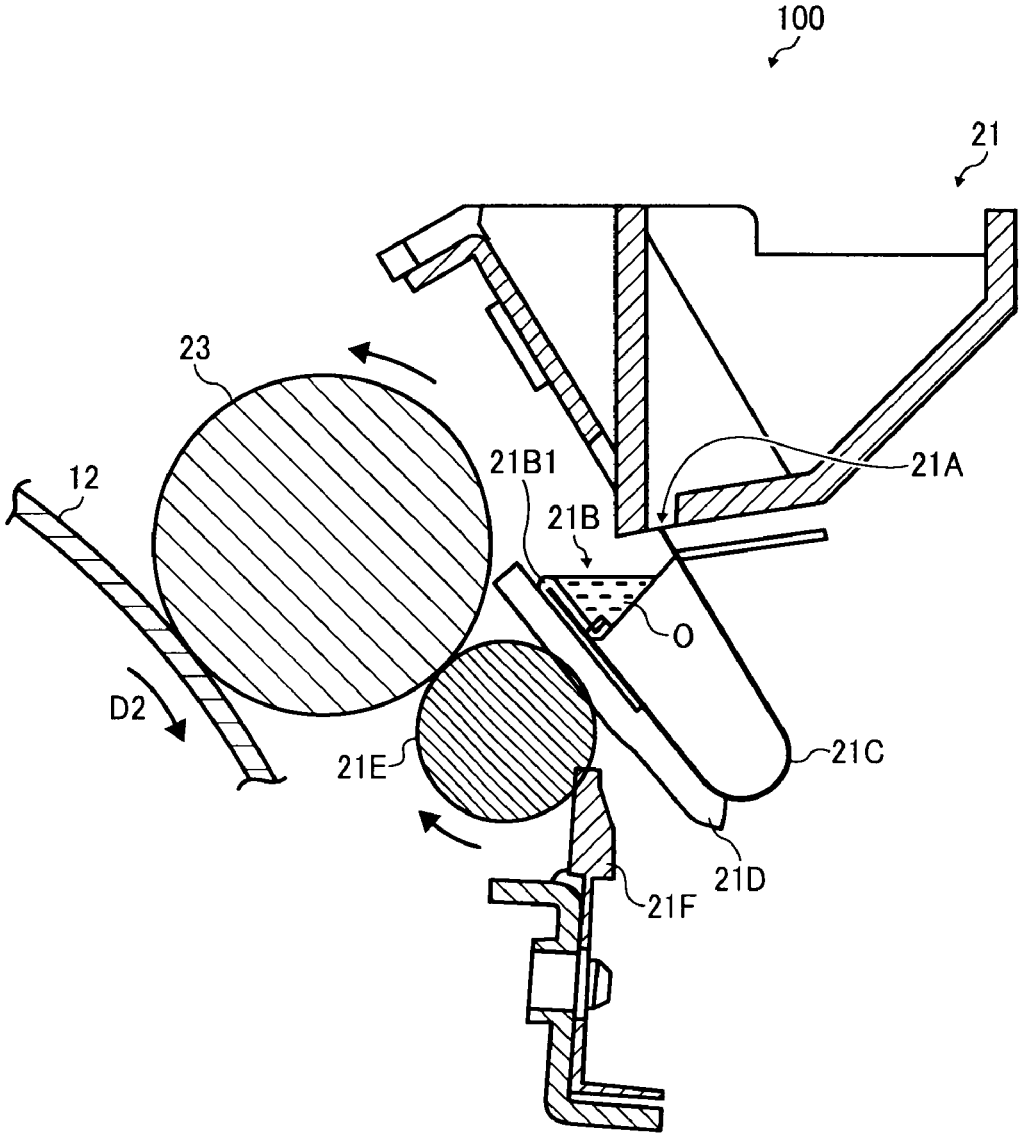
FIG. 4 is a partially sectional view of the fixing device shown in FIG. 3.

FIG. 4 is a partially sectional view of the fixing device 100. The fixing device 100 includes the fixing belt 12 and the oil applier 21. The oil applier 21 includes an application roller 23, an oil inlet 21A, an oil storage 21B, a support plate 21C, a supply felt 21D, a supply roller 21E, and a metering blade 21F. The oil storage 21B includes a cut portion 21B1.

The fixing belt 12, serving as a fixing member, rotates in the direction of rotation D2. The pressing roller 13 (depicted in FIG. 3), serving as a pressing member, contacts the fixing belt 12 to form the fixing nip portion N (depicted in FIG. 3) between the fixing belt 12 and the pressing roller 13. The oil applier 21 (e.g., an oil supplier) includes an oil application member and an oil supply mechanism. The oil application member includes the application roller 23, and applies oil O to the fixing belt 12 or the pressing roller 13 in a predetermined width of the fixing belt 12 or the pressing roller 13. The oil supply mechanism supplies oil O to the oil application member, and includes the oil inlet 21A, the oil storage 21B, the support plate 21C, the supply felt 21D, the supply roller 21E, and the metering blade 21F.

In the oil supply mechanism, the oil storage 21B is an upwardly concave gutter, that is, a concave portion or a concave member having a gutter-like shape, and receives and stores oil O put through the oil inlet 21A. A longitudinal direction of the oil storage 21B is parallel to a longitudinal direction (e.g., a width direction or an axial direction) of the application roller 23 serving as the oil application member. The oil storage 21B is provided above the adjacent supply felt 21D (e.g., a felt member) serving as an oil supply member. When oil O is put into the oil storage 21B through the oil inlet 21A, the oil O overflows the oil storage 21B at an upper portion or an upper edge (e.g., the cut portion 21B1) of the oil storage 21B, and flows into the adjacent supply felt 21D.

The above-described structure of the oil applier 21 for applying oil O to the fixing belt 12 is also applicable to the oil applier 22 (depicted in FIG. 3) for applying oil O to the pressing roller 13.

Figure 5:
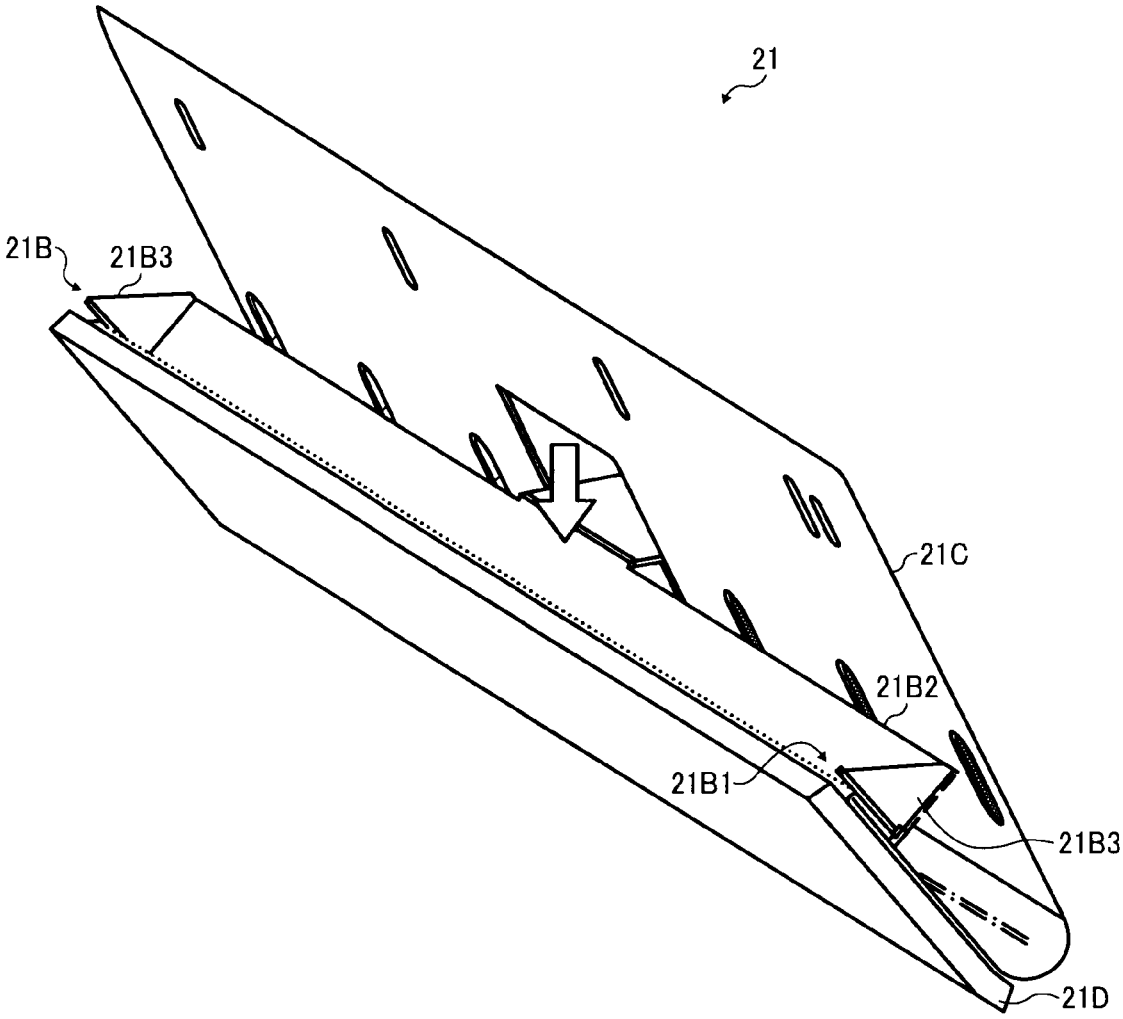
FIG. 5 is a partial perspective view of an oil applier included in the fixing device shown in FIG. 4.

FIG. 5 is a partial perspective view of the oil applier 21. Namely, FIG. 5 is a perspective view of a part of the oil supply mechanism of the oil applier 21, which are the oil storage 21B, the support plate 21C, and the supply felt 21D. The oil storage 21B further includes a gutter 21B2 and side plates 21B3.

The oil storage 21B is the upwardly concave gutter, that is, the concave portion or the concave member having the gutter-like shape, and includes the gutter 21B2 and the side plates 21B3. The gutter 21B2 has a V-like shape in cross-section. The side plates 21B3 are provided at both ends of the gutter 21B2 in a longitudinal direction of the gutter 21B2, and close a channel of the gutter 21B2. As illustrated in FIG. 4, the support plate 21C supports the oil storage 21B in such a manner that the oil storage 21B is disposed above the supply roller 21E and that the longitudinal direction of the gutter 21B2 (depicted in FIG. 5) is parallel to a width direction (e.g., an axial direction) of the supply roller 21E, the width direction (e.g., the axial direction) of the application roller 23, and a width direction (e.g., an axial direction) of the fixing belt 12. As illustrated in FIG. 5, the gutter 21B2 is formed of a loop-back portion of the support plate 21C provided at one end of the support plate 21C and a band plate of which end is fixed to the loop-back portion of the support plate 21C. The side plates 21B3 are fixed to both ends of the gutter 21B2 in the longitudinal direction of the gutter 21B2. Alternatively, the gutter 21B2 may be molded by sheet metal processing and the side plates 21B3 may be attached to the gutter 21B2. Yet alternatively, the gutter 21B2 may be molded with the side plates 21B3. Further, the oil storage 21B may include heat-resistant metal or plastic not reacting to oil O.

As illustrated in FIG. 4, an upper open end of the oil storage 21B facing the adjacent supply felt 21D serves as the cut portion 21B1 provided at a position lower than other ends of the oil storage 21B (e.g., another end of the gutter 21B2 and upper ends of the side plates 21B3 depicted in FIG. 5). When the fixing device 100 is driven, oil O is put into the oil storage 21B through the oil inlet 21A at a center of a width direction (e.g., the longitudinal direction) of the oil storage 21B until the oil O overflows the oil storage 21B. The oil O starts flowing out of the cut portion 21B1, and is supplied to the application roller 23 via the adjacent supply felt 21D and the supply roller 21E. Specifically, the oil O overflows the oil storage 21B in a full width of the cut portion 21B1, and thereby is supplied to the supply roller 21E and the application roller 23 in a predetermined width (e.g., a full width) of the supply roller 21E and the application roller 23 via the supply felt 21D. Thereafter, the oil O is applied to the fixing belt 12 in a predetermined width (e.g., a full width) of the fixing belt 12.

The support plate 21C is formed in a gutter-like shape having a U-like shape in cross-section, and supports the oil storage 21B and the supply felt 21D. When the support plate 21C is formed of a metal material by sheet metal processing to have proper spring property, the support plate 21C causes the supply felt 21D to contact the supply roller 21E while applying constant pressure to the support roller 21E.

The supply felt 21D is provided adjacent to the oil storage 21B, and supplies oil O from an upper portion or an upper edge (e.g., the cut portion 21B1) of the oil storage 21B to the supply roller 21E. For example, the supply felt 21D is provided between the oil storage 21B and the supply roller 21E, and contacts the oil storage 21B in a state in which a height of an upper end of the supply felt 21D is equal to a height of an upper end of the cut portion 21B1 of the oil storage 21B. Alternatively, the upper end of the supply felt 21D may protrude upward from the upper end of the cut portion 21B1 of the oil storage 21B. The supply felt 21D may be a compressed sheet including heat-resistant fiber not reacting to oil O, such as meta-aramid fiber. Oil O permeates the fiber of the supply felt 21D while the supply felt 21D holds the oil O inside. Therefore, the fiber of the supply felt 21D may have a mesh rougher than a mesh of a filter used for removing impurities. Thus, the supply felt 21D receives oil O flowing from the cut portion 21B1 and the oil O flows along the supply felt 21D. According to this exemplary embodiment, oil O falls down freely from the upper portion, that is, the cut portion 21B1, of the oil storage 21B to the supply roller 21E by gravity. The supply felt 21D supplies oil O to the supply roller 21E at a contact portion for contacting the supply roller 21E.

The oil supply mechanism further includes the supply roller 21E and the metering blade 21F. The supply roller 21E receives oil O from the supply felt 21D. The metering blade 21F adjusts an amount of oil O adhered to the supply roller 21E (e.g., an amount of oil O held by the supply roller 21E). A surface of the supply roller 21E includes a material corresponding to the oil O, such as silicon rubber. The metering blade 21F includes a material capable of regulating the amount of oil O adhering to the supply roller 21E without damaging the surface of the supply roller 21E, such as fluorocarbon rubber.

Figure 6:
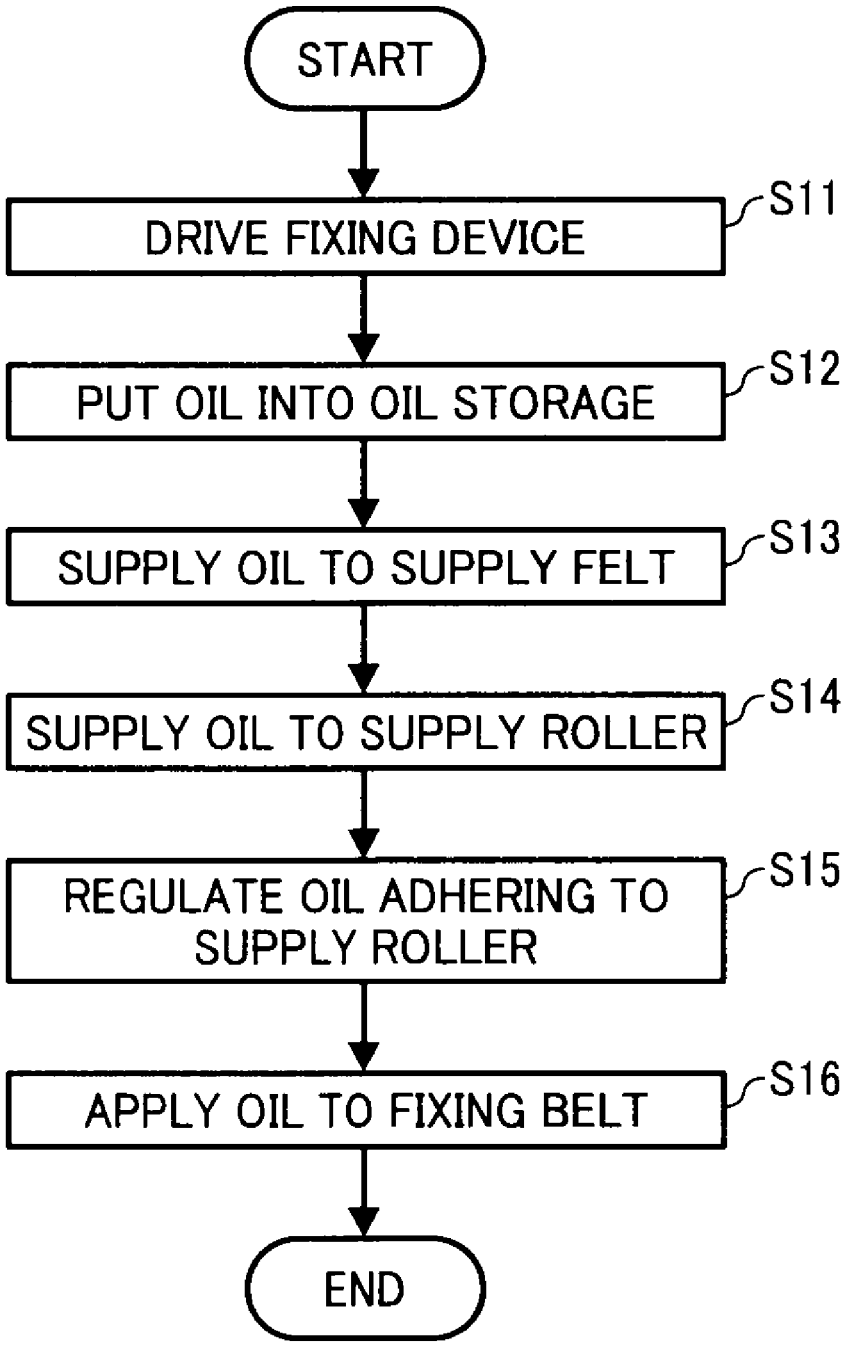
FIG. 6 is a flowchart illustrating a procedure for supplying oil from an oil supply mechanism to an oil application member in the oil applier shown in FIG. 5.

Referring to FIGS. 4 to 6, the following describes a procedure for supplying oil O from the oil supply mechanism to the oil application member with the above-described structure. FIG. 6 is a flowchart illustrating the procedure for supplying oil O from the oil supply mechanism to the oil application member.

In step S11, the fixing device 100 is driven. Accordingly, when the fixing belt 12 rotates, the supply roller 21E starts rotating. The application roller 23 contacting the fixing belt 12 and the supply roller 21E also starts rotating.

Simultaneously, in step S12, oil O is put into the oil storage 21B through the oil inlet 21A to store the oil O in the oil storage 21B.

In step S13, oil O continues being put into the oil storage 21B, and the oil O overflows the oil storage 21B. Specifically, the oil O overflows in the full width of the cut portion 21B1 of the oil storage 21B to supply the oil O to the supply felt 21D in a full width of the supply felt 21D.

In step S14, the oil O permeates the supply felt 21D from the upper portion to a lower portion of the supply felt 21D. The supply felt 21D supplies the oil O to the supply roller 21E in the predetermined width of the supply roller 21E at the contact portion for contacting the supply roller 21E.

In step S15, the rotating supply roller 21E moves an oiled portion of the supply roller 21E supplied with the oil O, and the metering blade 21F contacting the supply roller 21E regulates the amount of oil O adhering to the supply roller 21E.

In step S16, the supply roller 21E supplies the oil O to the application roller 23 in the predetermined width of the application roller 23 at a contact portion for contacting the application roller 23. Thereafter, the application roller 23 applies the oil O to the fixing belt 12 in the predetermined width of the fixing belt 12.

As described above, according to this exemplary embodiment, oil O flows down from the oil storage 21B, which is provided above the supply roller 21E, to the supply roller 21E by gravity. Thus, a sufficient amount of oil O can be supplied from the oil storage 21B to the supply roller 21E stably.

In general fixing devices, the supply roller 21E is driven by a driving force for driving elements in the fixing device other than the supply roller 21E, for example, by a driving force for driving the fixing roller 11 or the heating roller 14 (depicted in FIG. 3) transmitted via gears. The driving force is transmitted to the supply roller 21E at a fixed rotation ratio. Namely, the supply roller 21E is driven at a number of rotations (e.g., a speed) proportional to a number of rotations (e.g., a speed) of the fixing roller 11 or the heating roller 14. The rotating supply roller 21E rotates the application roller 23. Therefore, an amount of oil O applied to the fixing belt 12 via the supply roller 21E and the application roller 23 is proportional to the number of rotations (e.g., the speed) of the fixing roller 11 or the heating roller 14.

When a sheet easily absorbing oil O, such as coated paper, is used as a sheet P, an amount of oil O greater than an amount of oil O applied when plain paper is used as a sheet P needs to be applied to the fixing belt 12 and the pressing roller 13 depicted in FIG. 3, so as to provide improved property for separating a sheet P bearing a fixed toner image T from the fixing belt 12 or the pressing roller 13 and improved quality of a fixed toner image T.

To address this, a sufficient amount of oil O can be supplied from the oil storage 21B to the supply roller 21E stably with the structure shown in FIGS. 4 and 5. However, in general fixing devices as described above, the rotation ratio of the supply roller 21E is fixed with respect to the fixing roller 11 or the heating roller 14. Accordingly, an amount of oil O applied to the fixing belt 12 or the pressing roller 13 may not be increased. For example, oil shortage may occur when a high-quality color toner image is to be formed on coated paper at a speed of 90 sheets per minute.

To address this, the fixing device 100, having the structure shown in FIGS. 3 to 5, includes the oil applier 21 including the application roller 23 and the oil supply mechanism for supplying oil O to the application roller 23. The application roller 23 is rotated at an arbitrary number of rotations (e.g., an arbitrary speed) by a driving force supplied directly or indirectly by a motor (e.g., a driving motor), which is independent of other drivers, and applies oil O to the fixing belt 12 or the pressing roller 13.

Figure 7:
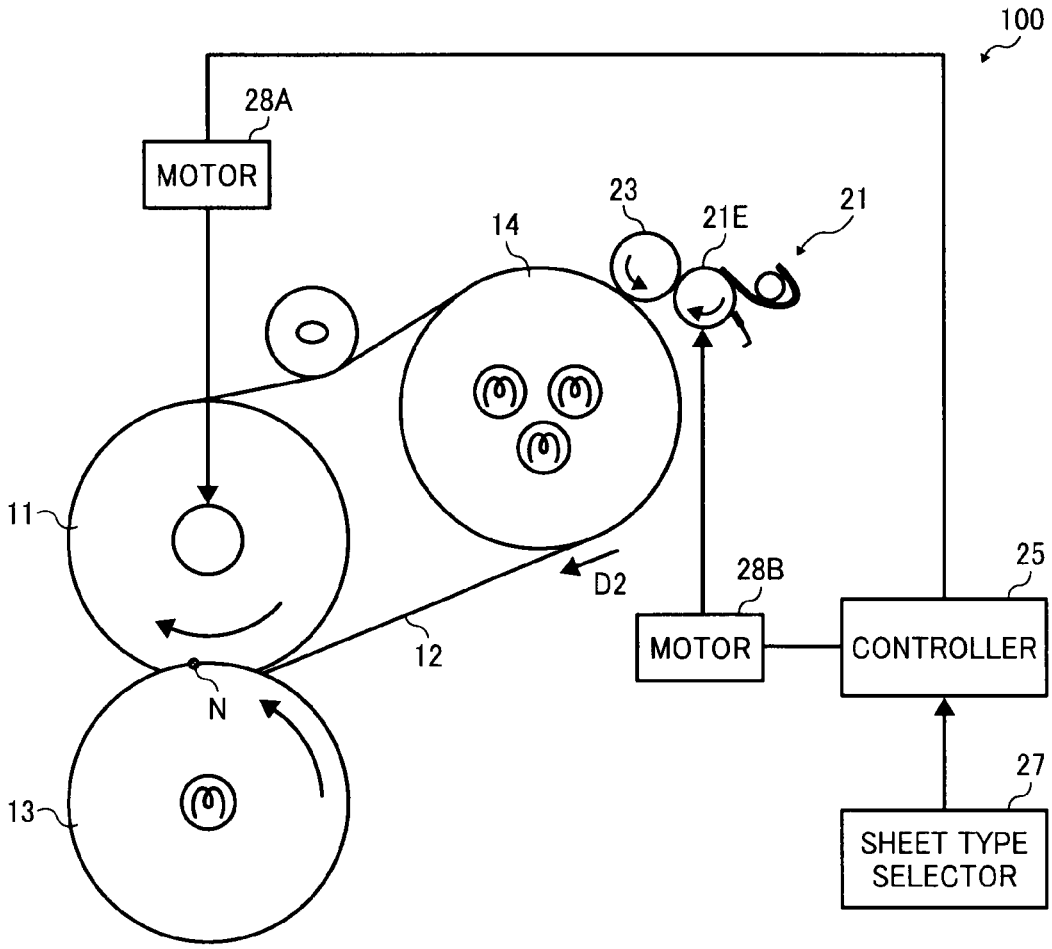
FIG. 7 is a schematic view of a driver of the fixing device shown in FIG. 3.

FIG. 7 is a schematic view of a driver of the fixing device 100. The fixing device 100 further includes a controller 25, a sheet type selector 27, and motors 28A and 28B.

In the fixing device 100, the fixing belt 12, serving as a fixing member, is looped over the fixing roller 11 and the heating roller 14 with predetermined tension. The pressing roller 13, serving as a pressing member, rotatably presses against the fixing belt 12 to form the fixing nip portion N between the fixing belt 12 and the pressing roller 13. The oil applier 21 (e.g., an oil supplier) includes an oil application member and an oil supply mechanism. The oil application member includes the application roller 23, and applies oil O to the fixing belt 12 or the pressing roller 13 in a predetermined width of the fixing belt 12 or the pressing roller 13. The oil supply mechanism supplies oil O to the oil application member, and includes the oil inlet 21A, the oil storage 21B, the support plate 21C, the supply felt 21D, the supply roller 21E, and the metering blade 21F depicted in FIG. 4.

The motor 28A drives the fixing belt 12. The motor 28B is independent of other drivers and drives the supply roller 21E. The controller 25 controls driving of the respective motors 28A and 28B. The sheet type selector 27, serving as a type selector, inputs information about type of a sheet P, which is selected by a user to bear a toner image T to be fixed, to the controller 25.

The controller 25 controls the motors 28A and 28B to change a number of rotations (e.g., a speed) of the application roller 23 according to type of a sheet P bearing a toner image T to be fixed, so as to adjust an amount of oil O to be applied to the fixing belt 12 or the pressing roller 13.

Figure 8:
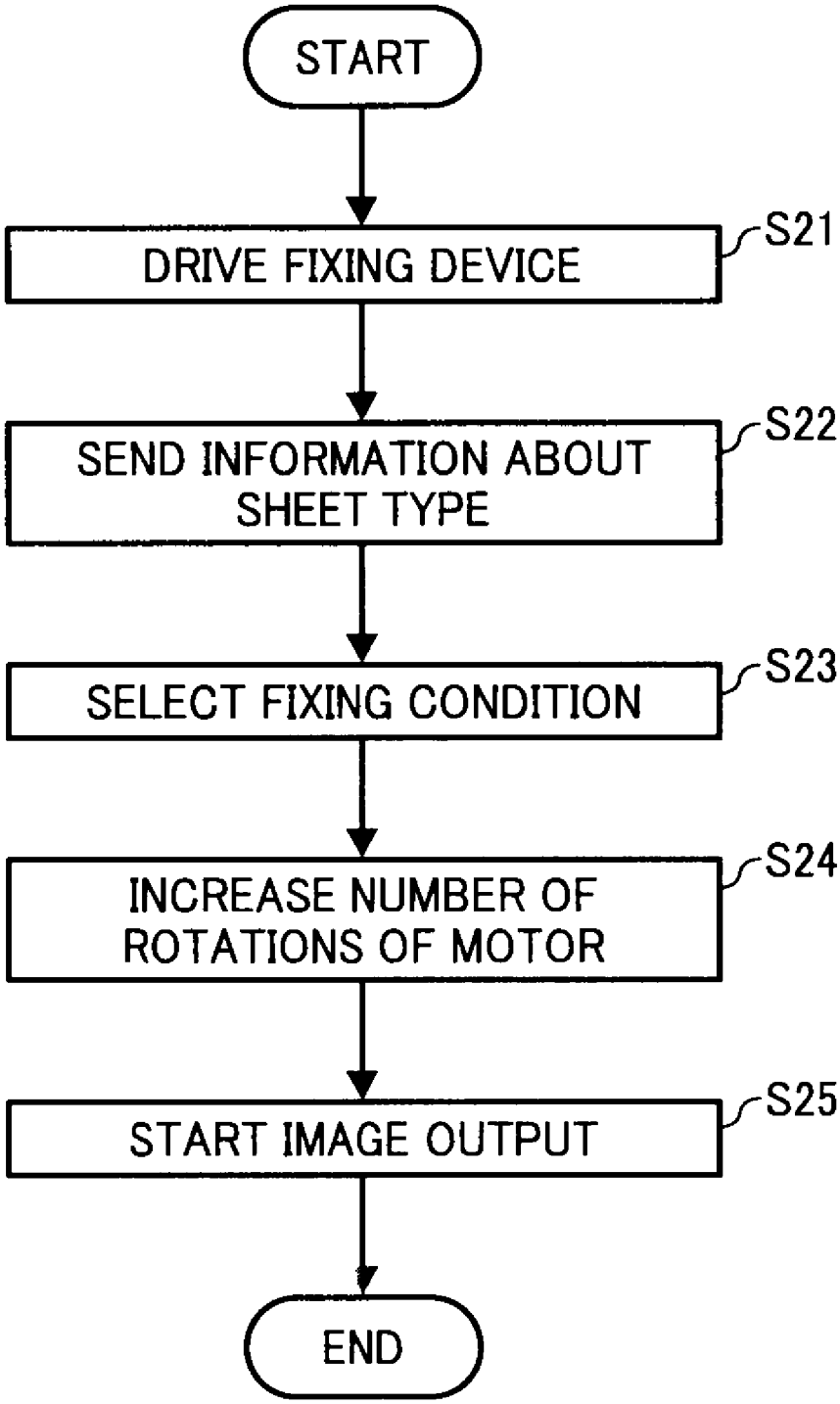
FIG. 8 is a flowchart illustrating a procedure for adjusting an amount of oil to be applied to a fixing belt or a pressing roller included in the fixing device shown in FIG. 7.

Referring to FIGS. 7 and 8, the following describes a procedure for adjusting an amount of oil O to be applied to the fixing belt 12 or the pressing roller 13. FIG. 8 is a flowchart illustrating the procedure for adjusting the amount of oil O to be applied to the fixing belt 12 or the pressing roller 13.

In step S21, when a user inputs a command for performing a fixing operation (e.g., a command for performing an image forming operation), the fixing device 100 is driven. Accordingly, the controller 25 drives the motors 28A and 28B and other drivers under predetermined normal conditions, for example, to perform the processes shown in steps S11 to S16 in FIG. 6.

In step S22, the sheet type selector 27 sends information about type of a sheet P selected by the user (e.g., plain paper, coated paper, or film) to the controller 25. The controller 25 receives and confirms the information.

In step S23, the controller 25 selects an appropriate fixing condition from among predetermined fixing conditions based on the information about the type of the sheet P selected by the user and other information about thickness of the sheet P, type of toner, and mode of image formation (e.g., color mode or monochrome mode), so as to control driving of the fixing device 100 according to the selected fixing condition.

In step S24, when the type of the sheet P selected by the user is coated paper, the controller 25 increases a number of rotations (e.g., a speed) of the motor 28B to a number of rotations (e.g., a speed) greater than a number of rotations (e.g., a speed) applied to plain paper. Accordingly, a number of rotations (e.g., a speed) of the application roller 23 increases, and an increased amount of oil O is adhered to the fixing belt 12.

In step S25, when other fixing conditions are satisfied, an image output starts. Since a sufficient amount of oil O is applied to the fixing belt 12 and the pressing roller 13 stably, the sheet P, that is, coated paper, bearing a fixed toner image T is discharged out of the fixing nip portion N without adhering to or wrapping around the fixing belt 12 and the pressing roller 13.

Oil O used in the fixing device 100 has a certain level of viscosity. Therefore, even when oil O is put into the oil storage 21B through the oil inlet 21A depicted in FIG. 4, the oil O does not spread in the width direction of the oil storage 21B quickly. For example, oil O accumulates at a position on the oil storage 21B corresponding to the oil inlet 21A. Namely, a level of oil O may be highest at the position on the oil storage 21B corresponding to the oil inlet 21A and may become lower toward both ends in the width direction of the oil storage 21B. Accordingly, distribution of an amount of oil O overflowing the cut portion 21B1 depicted in FIG. 4 of the oil storage 21B and flowing onto the supply roller 21E depicted in FIG. 4 may be uneven in the width direction of the supply roller 21E.

To address this, a draw felt (e.g., a draw felt member) may be provided in a draw region on the oil storage 21B other than a region in which the oil inlet 21A is provided in the width direction of the oil storage 21B, so that the draw felt draws oil O from the gutter 21B2 depicted in FIG. 5 of the oil storage 21B to the supply felt 21D depicted in FIG. 4. Thus, oil O is also supplied from the draw region of the oil storage 21B to the supply felt 21D easily. In this case, capillary phenomenon supplies oil O from the draw felt to the supply felt 21D. However, capillary phenomenon is used secondarily to adjust distribution of oil O in a width direction (e.g., a longitudinal direction) of the supply felt 21D. Moreover, a distance between the draw felt and the supply felt 21D is small. Thus, the draw felt can provide practical utility.

Alternatively, a plurality of oil inlets 21A may be provided in the width direction of the oil storage 21B, so that oil O put into the oil storage 21B through the plurality of oil inlets 21A has a uniform height in the width direction of the oil storage 21B.

Yet alternatively, a height of the upper end of the cut portion 21B1 depicted in FIG. 4 of the oil storage 21B may be higher at a position corresponding to the oil inlet 21A than a height of the upper end of the cut portion 21B1 at other positions. Thus, an amount of oil O overflowing the cut portion 21B1 can be adjusted in the width direction of the oil storage 21B.

Figure 9:
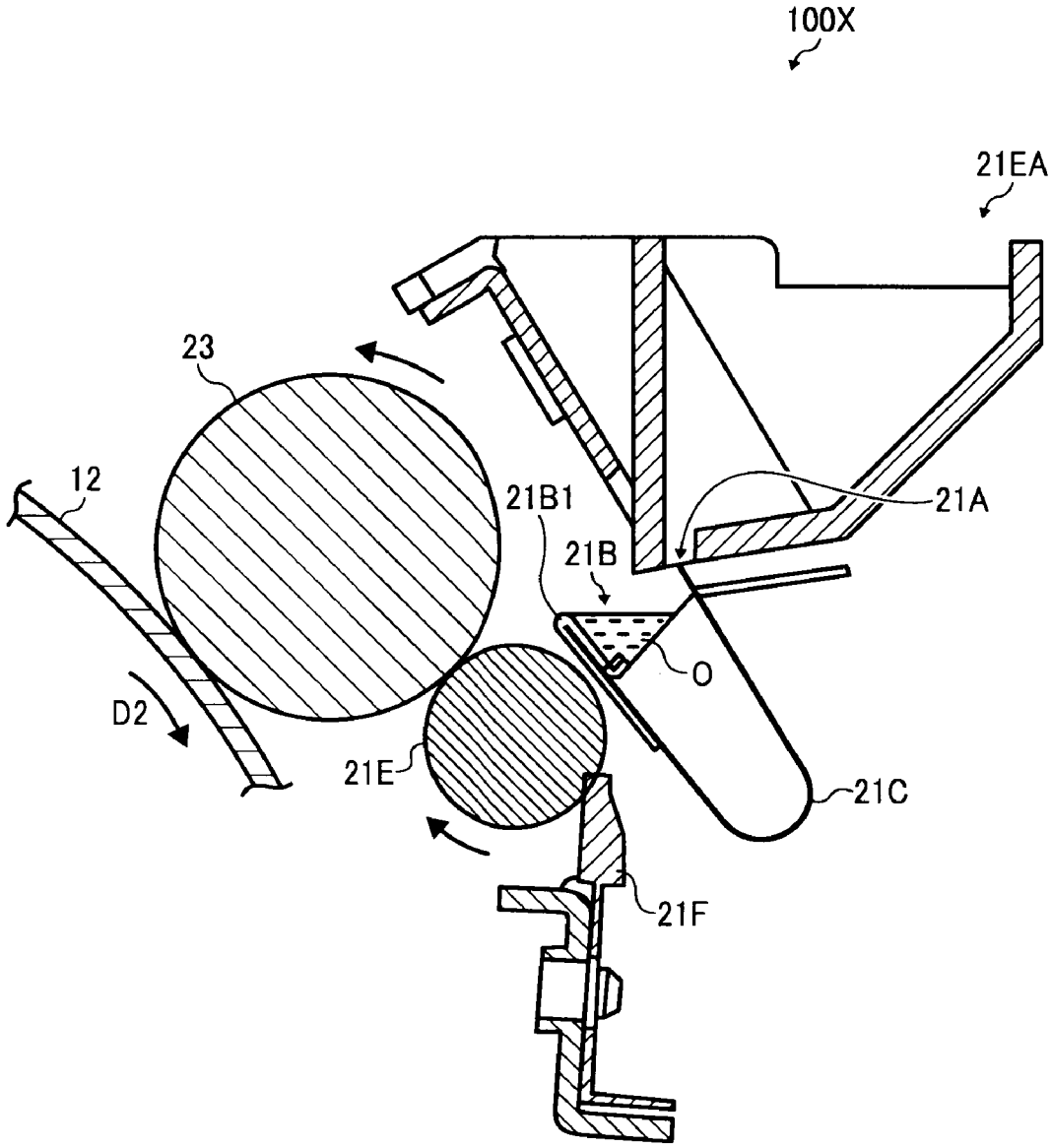
FIG. 9 is a partially sectional view of a fixing device according to another exemplary embodiment of the present invention.

Referring to FIG. 9, the following describes a fixing device 100X according to another exemplary embodiment. FIG. 9 is a partially sectional view of the fixing device 100X. The fixing device 100X includes an oil applier 21EA. In the fixing device 100X, the oil applier 21EA does not include the supply felt 21D depicted in FIG. 4. The other elements of the fixing device 100X are common to the fixing device 100 depicted in FIG. 4.

Since the oil applier 21EA does not include the supply felt 21D, the oil storage 21B is provided adjacent to the supply roller 21E.

The fixing belt 12, serving as a fixing member, rotates in the direction of rotation D2. The pressing roller 13 (depicted in FIG. 7), serving as a pressing member, contacts the fixing belt 12 to form the fixing nip portion N (depicted in FIG. 7) between the fixing belt 12 and the pressing roller 13. The oil applier 21EA (e.g., an oil supplier) includes an oil application member and an oil supply mechanism. The oil application member includes the application roller 23, and applies oil O to the fixing belt 12 or the pressing roller 13 in a predetermined width of the fixing belt 12 or the pressing roller 13. The oil supply mechanism supplies oil O to the oil application member, and includes the oil inlet 21A, the oil storage 21B, the support plate 21C, the supply roller 21E, and the metering blade 21F.

In the oil supply mechanism, the oil storage 21B is the upwardly concave gutter, that is, the concave portion or the concave member having the gutter-like shape, and receives and stores oil O put through the oil inlet 21A. The longitudinal direction of the oil storage 21B is parallel to the longitudinal direction (e.g., the width direction or the axial direction) of the application roller 23. The oil storage 21B is provided above the adjacent supply roller 21E serving as an oil supply member. When oil O is put into the oil storage 21B through the oil inlet 21A, the oil O overflows the oil storage 21B at the upper portion or the upper edge (e.g., the cut portion 21B1) of the oil storage 21B, and flows onto the adjacent supply roller 21E.

The oil applier 21EA can provide effects similar to the effects provided by the oil applier 21 depicted in FIG. 4.

The above-described structure of the oil applier 21EA for applying oil O to the fixing belt 12 is also applicable to the oil applier 22 (depicted in FIG. 3) for applying oil O to the pressing roller 13.

In the fixing device 100 depicted in FIG. 4 and the fixing device 100X depicted in FIG. 9, the fixing belt 12, serving as a fixing member, is disposed above the pressing roller 13 serving as a pressing member. Alternatively, a fixing member having a roller shape may be provided above a pressing member having a belt shape, as illustrated in FIG. 10.

Figure 10:
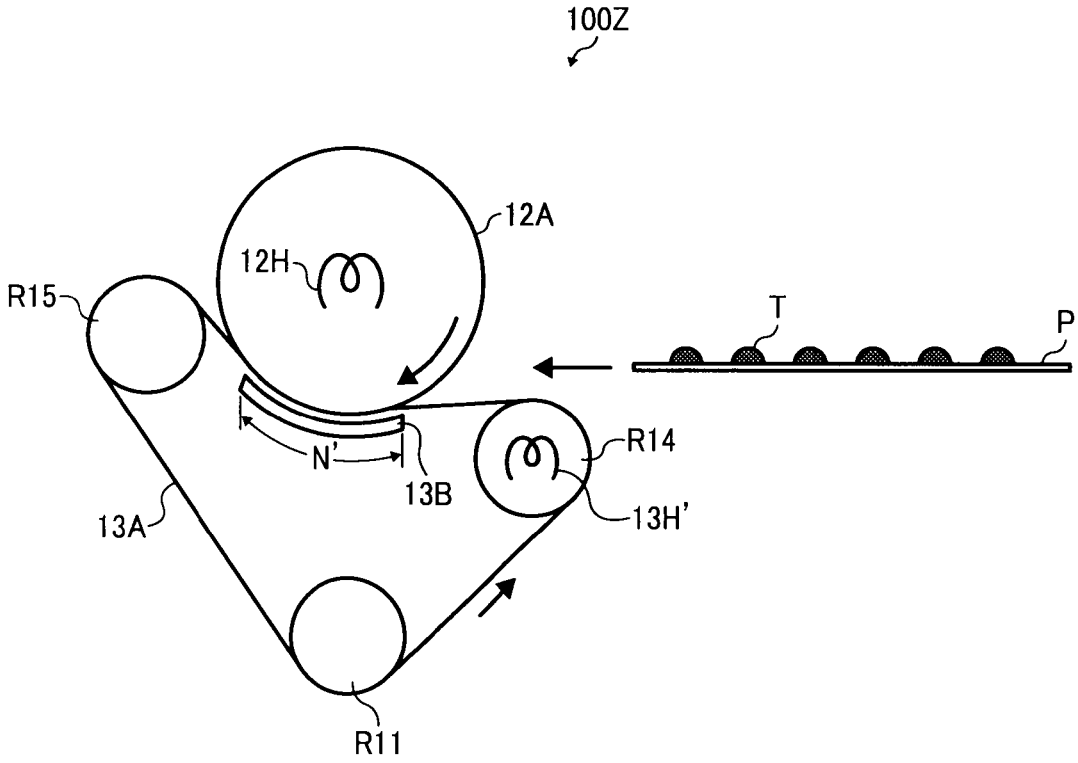
FIG. 10 is a sectional view of a fixing device according to yet another exemplary embodiment of the present invention.

Referring to FIG. 10, the following describes a fixing device 100Z according to yet another exemplary embodiment. FIG. 10 is a sectional view of the fixing device 100Z. The fixing device 100Z includes a fixing roller 12A, a heater 12H, rollers R11, R14, and R15, a pressing belt 13A, a backup member 13B, and a heater 13H'.

The fixing roller 12A, serving as a fixing member, is provided above the pressing belt 13A serving as a pressing member, and rotates clockwise in FIG. 10. The pressing belt 13A provided under the fixing roller 12A rotates counterclockwise in FIG. 10, and is looped over the rollers R11, R14, and R15. The backup member 13B, serving as a pressing pad, faces an inner circumferential surface of the pressing belt 13A to cause the pressing belt 13A to contact the fixing roller 12A and form a fixing nip portion N' between the fixing roller 12A and the pressing belt 13A. The heater 12H is provided inside the fixing roller 12A, and generates heat to heat the fixing roller 12A. The heater 13H' is provided inside the roller R14, and generates heat to heat the pressing belt 13A.

The oil applier 21 depicted in FIG. 3 applies oil to the fixing roller 12A provided above the pressing belt 13A. The oil applier 22 depicted in FIG. 3 applies oil to the pressing belt 13A provided under the fixing roller 12A.

According to the above-described exemplary embodiments, in a fixing device (e.g., the fixing device 100 depicted in FIG. 7, the fixing device 100X depicted in FIG. 9, or the fixing device 100Z depicted in FIG. 10), an independent motor (e.g., the motor 28B depicted in FIG. 7) drives an application roller (e.g., the application roller 23 depicted in FIG. 7) to rotate the application roller at an arbitrary number of rotations (e.g., an arbitrary speed). Accordingly, an arbitrary amount of oil can be applied to a fixing member (e.g., the fixing belt 12 depicted in FIGS. 7 and 9 or the fixing roller 12A depicted in FIG. 10) and/or a pressing member (e.g., the pressing roller 13 depicted in FIG. 3 or the pressing belt 13A depicted in FIG. 10) according to type of a sheet (e.g., a sheet P), maintaining proper property for separating the sheet from the fixing member and/or the pressing member. For example, when the sheet is coated paper, an amount of oil applied to the fixing member and the pressing member is increased to an amount of oil greater than an amount of oil applied to plain paper, providing improved image quality as well as the proper property for separating the sheet from the fixing member and/or the pressing member.

According to the above-described exemplary embodiments, an image forming apparatus (e.g., the image forming apparatus 200 depicted in FIG. 2) including the fixing device can provide improved fixing and separation functions, and therefore can handle various types of paper, such as thin paper, thick paper, and coated paper, and various types of image formation, such as a narrower top margin on a sheet.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device, comprising:

a rotatable fixing member;

a pressing member to contact the fixing member;

a motor; and an oil applier, the oil applier comprising:

an application roller to apply oil to one of the fixing member and the pressing member; and an oil supply mechanism to supply oil to the application roller, the oil supply mechanism including a meter blade to meter an amount of oil on the application roller, an oil storage having an upper edge, a supply roller and a supply felt between the supply roller and the oil storage, the supply felt located completely outside of the oil storage, wherein the motor only controls an oiling operation supplying a driving force to the application roller to rotate the application roller at an arbitrary speed, and wherein an upper end of the supply felt protrudes upwardly beyond the upper edge of the oil storage.

2. The fixing device according to claim 1, further comprising:

a controller to adjust an amount of oil to be applied to one of the fixing member and the pressing member;

a type selector to provide information about type of a recording medium selected by a user to the controller, wherein:

the controller changes the speed of the application roller according to the type of the recording medium provided by the type selector to adjust the amount of oil to be applied to one of the fixing member and the pressing member.

3. The fixing device according to claim 2, wherein, when the recording medium is coated paper, the controller increases the speed of the application roller to a speed greater than a speed for plain paper.

4. An image forming apparatus comprising a fixing device, the fixing device comprising:

a rotatable fixing member;

a pressing member to contact the fixing member;

a motor; and an oil applier, the oil applier comprising:

an application roller to apply oil to one of the fixing member and the pressing member; and an oil supply mechanism to supply oil to the application roller, the oil supply mechanism including a meter blade to meter an amount of oil on the application roller, an oil storage having an upper edge, a supply roller, and a supply felt between the supply roller and the oil storage, the supply felt located completely outside of the oil storage, wherein the motor only controls an oiling operation supplying a driving force to the application roller to rotate the application roller at an arbitrary speed, and wherein an upper end of the supply felt protrudes upwardly beyond the upper edge of the oil storage.

5. The fixing device according to claim 1, wherein:

a point of contact of the supply felt and the supply roller is higher than an axis of rotation of the supply roller.

6. The fixing device according to claim 2, wherein:

a point of contact of the supply felt and the supply roller is higher than an axis of rotation of the supply roller.

7. The image forming apparatus according to claim 4, wherein:

a point of contact of the supply felt and the supply roller is higher than an axis of rotation of the supply roller.

8. The fixing device according to claim 1, wherein the fixing member includes:

a fixing belt to contact the pressing member to form a nip portion therebetween;

a fixing roller provided inside the fixing belt and pressed against the pressing member via the fixing belt; and a heating roller provided inside the fixing belt to heat the fixing belt, wherein the fixing belt is looped over the fixing roller and the heating roller.

9. The fixing device according to claim 2, wherein the fixing member includes:

a fixing belt to contact the pressing member to form a nip portion therebetween;

a fixing roller provided inside the fixing belt and pressed against the pressing member via the fixing belt; and a heating roller provided inside the fixing belt to heat the fixing belt, wherein the fixing belt is looped over the fixing roller and the heating roller.

10. An image forming apparatus according to claim 4, wherein the fixing member includes:

a fixing belt to contact the pressing member to form a nip portion therebetween;

a fixing roller provided inside the fixing belt and pressed against the pressing member via the fixing belt; and a heating roller provided inside the fixing belt to heat the fixing belt, wherein the fixing belt is looped over the fixing roller and the heating roller.

11. The fixing device according to claim 1, wherein:

the pressing member includes a pressing roller.

12. The fixing device according to claim 2, wherein:

the pressing member includes a pressing roller.

13. An image forming apparatus according to claim 4, wherein:

the pressing member includes a pressing roller.

14. The fixing device according to claim 1, wherein:

the pressing member includes a pressing belt looped over a plurality of rollers.

15. The fixing device according to claim 2, wherein:

the pressing member includes a pressing belt looped over a plurality of rollers.

16. An image forming apparatus according to claim 4, wherein:

the pressing member includes a pressing belt looped over a plurality of rollers.

17. A fixing device, comprising:

a rotatable fixing member;

a pressing member to contact the fixing member;

a motor which is independent of other drivers; and an oil applier which includes:

an application roller to apply oil to one of the fixing member and the pressing member; and an oil supply mechanism to supply oil to the application roller, the oil supply mechanism including an oil storage having an upper edge, a supply roller, and a supply felt between the supply roller and the oil storage, the supply felt located completely outside of the oil storage, wherein the motor only controls an oiling operation and supplies a driving force to the application roller to rotate the application roller, and wherein an upper end of the supply felt protrudes upwardly beyond the upper edge of the oil storage.

18. The fixing device according to claim 17, wherein:

a point of contact of the supply felt and the supply roller is higher than an axis of rotation of the supply roller.

19. The fixing device according to claim 17, wherein:

the pressing member includes a pressing roller.

20. The fixing device according to claim 17, wherein:

the pressing member includes a pressing belt looped over a plurality of rollers.

* * * * *